US005561858A

United States Patent [19]

Poirier

[11] Patent Number: 5,561,858

[45] Date of Patent: Oct. 8, 1996

[54] SWIMSUIT FOR INFANTS

[76] Inventor: Debra Poirier, R.R. #2, Box 365, North Berwick, Me. 03906

[21] Appl. No.: 253,358

[22] Filed: Jun. 3, 1994

[51] Int. Cl.[6] ..... A41D 11/00; A41D 7/00

[52] U.S. Cl. ..... 2/67; 2/408; 2/75; 2/69

[58] Field of Search ..... 2/67, 75, 69, 69.5, 2/80, 83, 400, 401, 402, 403, 404, 405, 406, 407, 408, 79, 227; 24/114.9, 113 NP, 107, 618, 623

[56] References Cited

U.S. PATENT DOCUMENTS

| | | | |
|---|---|---|---|
| 436,607 | 9/1890 | Litle | 2/67 X |
| 599,408 | 2/1898 | Uppercu | 2/67 |
| 1,260,873 | 3/1918 | Coleman | 2/111 X |
| 1,954,526 | 4/1934 | Holahan | 2/67 |
| 2,028,602 | 1/1936 | Hanson | 2/70 X |
| 2,412,502 | 12/1946 | Garrison | 2/67 |
| 2,671,220 | 3/1954 | Geissmann | 2/111 X |
| 2,717,395 | 9/1955 | Holshouser | 2/75 |
| 2,748,517 | 6/1956 | Berkis | 24/114.9 |
| 2,857,600 | 10/1958 | Finn | 2/67 |
| 3,036,574 | 5/1962 | Jeffrey | 2/67 X |
| 5,308,671 | 5/1994 | Wells | 24/114.9 X |
| 5,367,709 | 11/1994 | Teasley | 2/75 X |

*Primary Examiner*—Jeanette E. Chapman
*Attorney, Agent, or Firm*—Frederick R. Cantor, Esq.

[57] ABSTRACT

A swimsuit for a female infant wearing a diaper, includes a tubular main section enclosing the torso of the infant, and a T-shaped flap extending from the lower rear extremity of the tubular main section. The flap includes a relatively narrow strip portion adapted to extend along the crotch area of the infant's body, and a relatively wide triangular portion adapted to extend across the infant's abdomen. Fastener assemblies are provided at the upper corner extremities of the flap for releasably securing the flap to the lower front edge of the swimsuit main section. The fastener assemblies can be disconnected (or detached) for unfolding the flap to expose the infant's diaper for diaper-changing purposes.

1 Claim, 3 Drawing Sheets

SWIMSUIT FOR INFANTS

BACKGROUND OF THE PRESENT INVENTION

1. Field of the Invention

The present invention relates to swimsuits for infants.

The present invention more particularly relates to swimsuits for infants and designed to facilitate changing the infant's diaper without removal of the swimsuit.

2. Prior Developments

Mothers with infants will sometimes let the infant sit or play in a wadding pool. Also, an infant may be allowed to sit on a wet beach, and play in the wet sand, e.g., fill a toy pail with water or sand, using a toy shovel or cup.

In either case, the infant will usually be wearing a bathing suit (or swimsuit). When the infant is wearing a diaper under the swimsuit there is a problem, in that water from the pool or wet beach can infiltrate the diaper so that it becomes water-logged and quite heavy. The weight of the water-saturated diaper can interfere with the infant's mobility and comfort.

Mothers commonly cope with this problem by changing the baby's diaper on a frequent basis, e.g., whenever the diaper becomes noticeably heavy. When the baby is wearing a conventional one piece bathing suit over the diaper, the bathing suit must be removed before the diaper can be changed. Removal of the bathing suit (swimsuit) can be tedious, and difficult, especially if the swimsuit is wet and impregnated with sand. The conventional one piece infant swimsuit has to be moved downwardly along the infant's body (or horizontally over the infant's feet if the infant is in a prone position). After the diaper has been changed the bathing suit has to be pulled back over the infant's body. When the swimsuit is wet or impregnated with sand the process can be time-consuming and also somewhat uncomfortable for the infant.

When the infant's diaper has to be changed on a frequent basis, the added requirement for removing the infant's swimsuit and later putting the swimsuit back on the infant can be an annoyance.

The present invention relates to infant swimsuits that can be opened to permit the infant's diaper to be changed, such that the swimsuit can remain on the infant during the diaper-changing process.

Prior to the present invention, infant T-shirts have been designed to facilitate diaper changing. Such T-shirts are commonly formed with strip-like extensions at the front and back for disposition in the crotch area between the legs. Snap action fasteners at the ends of these extensions can be snapped together to hold the T-shirt in place on the infant's body.

When it becomes necessary to change the infant's diaper the fasteners are disengaged, and the extensions pulled apart and up onto the infant's body to, at least partially, expose the diaper. The strip-like extensions are integral with the T-shirt, such that the extensions can be pulled only a limited amount away from the infant's body; usually the T-shirt has to be slid bodily along the infant's torso to gain complete access to the diaper.

SUMMARY OF THE PRESENT INVENTION

An object of the present invention is to provide a swimsuit for an infant wearing a diaper.

A further object of the present invention is to provide a swimsuit for an infant wearing a diaper, wherein the swimsuit comprises a main fabric section enclosing the torso, and a T-shaped fabric flap connected to said main section for disposition in the crotch area and over the abdomen of the infant. The T-shaped flap has a relatively wide portion extending across the abdomen area between the infant's hips; fastener members are located at the extremities of the relatively wide flap portion for detachable engagement with mating fasteners located on hip areas of the main fabric section.

When it is desired to change the infant's diaper, the infant is placed in a prone position facing upwardly. The mating fasteners are disengaged, and the T-shaped flap pulled away from the infant's body to fully expose the diaper. The T-shaped flap may be pushed down underneath the infant's legs so as to be out of the way during the diaper-changing process.

A principal advantage of the infant swimsuit (or bathing suit) is that it can be readily opened to gain full access to the diaper, without having to roll or shift the swimsuit bodily along the infant's torso. When the T-shaped flap is pulled away from the torso, the waist area of the diaper is fully exposed.

In preferred practice of the present invention ornamental shields, or disks, are attached to the extremities of the T-shaped flap to cover the associated fastener members. The bathing suit has a generally conventional appearance, so that casual observers are unaware that the infant is wearing a diaper under the bathing suit. This feature may be of interest to mothers, who may feel the infant might be self-conscious, wearing a swimsuit that other infants, or small children, might consider to have a diaper-like appearance or purpose. The swimsuit is designed to be worn by infants up to an age of about three years. children in this age group will often feel self-conscious if it is known that they are wearing diapers. The bathing suit of this invention is designed so that the diaper-access feature of the swimsuit is not readily apparent to other children.

In summary, and in accordance with the abo ve discussion, the foregoing objectives are achieved in the following embodiments:

1. A swimsuit for an infant wearing a diaper, comprising;

a main fabric section for enclosing the torso of an infant, said main section including fabric areas seatable against the hips and the buttocks of the infant;

a fabric flap extending forwardly from the buttocks area of said main section, said flap comprising a relatively narrow portion for enclosing the crotch area of the infant, and a relatively wide portion for enclosing the abdomen area of the infant;

said main fabric section having an inner surface and an outer surface;

said fabric flap having an inner surface and an outer surface;

first and second fastener members located on the outer surface of said main section at said hip-seating areas;

third and fourth fastener members located on the inner surface of said flap at the corner extremities of said relatively wide portion;

said third and fourth fastener members being engageable with said first and second fastener members, whereby the flap overlies a diaper worn by the infant; and said third and fourth fastener members being detachable from said first and second fastener members, whereby the relatively wide portion of the flap can be drawn away from the main fabric section to partially expose the diaper for permitting the diaper to be easily changed.

2. The swimsuit, as described in paragraph 1, and further comprising an ornamental means for concealing said third and fourth fastener members when said fastener members are engaged.

3. The swimsuit, as described in paragraph 2, wherein said ornamental means comprises two disks affixed to the outer surface of said flap at the extremities of the relatively wide portion of the flap, so that the disks conceal said third and fourth fastener members.

4. The swimsuit, as described in paragraph 2, wherein said ornamental means comprises a ruffle attached to said main section so as to hang down in front of said third and fourth fastener members.

5. The swimsuit, as described in paragraph 2, wherein said fastener members are interlocking snap-action fasteners.

6. The swimsuit, as described in paragraph 2, wherein said fabric flap has a T-shape.

7. The swimsuit, as described in paragraph 2, wherein said ornamental means comprises a ruffle attached to said main section so as to hang down from the ruffle attachment area; and said ruffle extending around the entire circumference of the swimsuit.

8. The swimsuit, as described in paragraph 1, wherein said main section has a lower front edge; and said first and second fastener members being located on said main section in immediate proximity to said lower front edge.

9. The swimsuit, as described in paragraph 1, wherein the relatively wide portion of said flap has a triangular shape.

A BRIEF DESCRIPTION OF THE DRAWINGS

DESCRIPTION OF THE PREFERRED EMBODIMENTS OF THE PRESENT INVENTION

Figure 1:
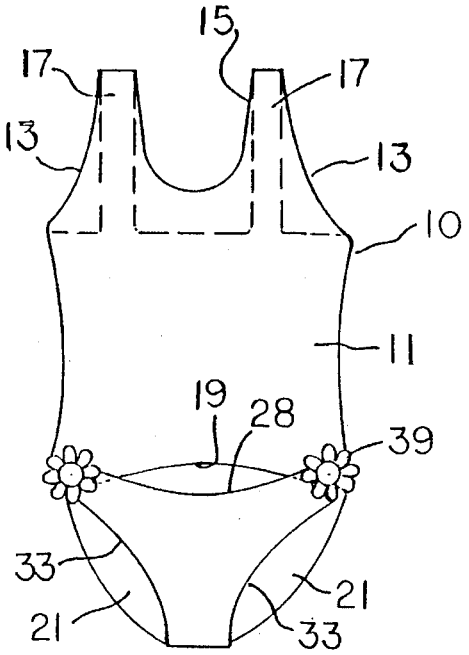
FIG. 1, is a front view of an infant swimsuit constructed according to the present invention.

FIG. 1, is a front view of an infant swimsuit constructed according to the present invention.

Figure 2:
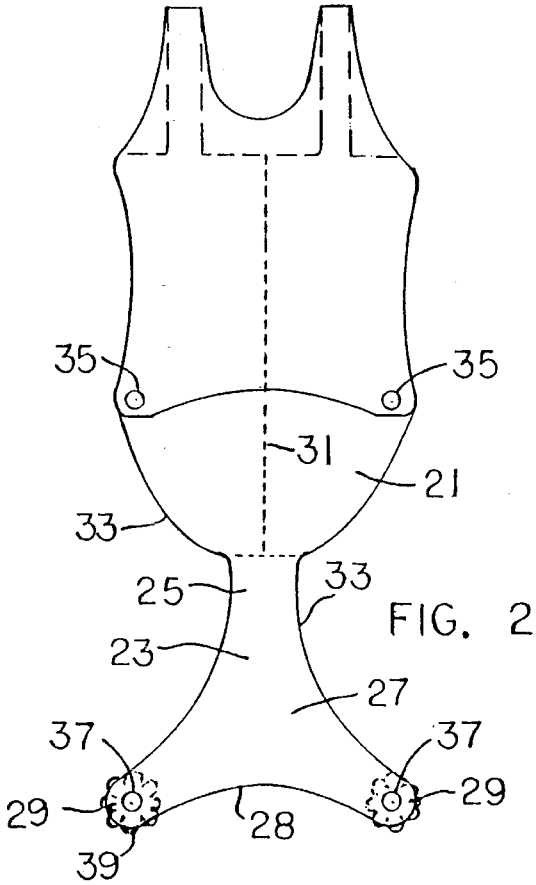
FIG. 2, is a view taken in the same direction as FIG. 1, but with a T-shaped flap pulled away from the main section of the swimsuit for access to a diaper worn underneath the swimsuit. The diaper is not shown in the drawings.

FIG. 2, is a view taken in the same direction as FIG. 1, but with a T-shaped flap pulled away from the main section of the swimsuit for access to a diaper worn underneath the swimsuit. The diaper is not shown in the drawings.

Figure 3:
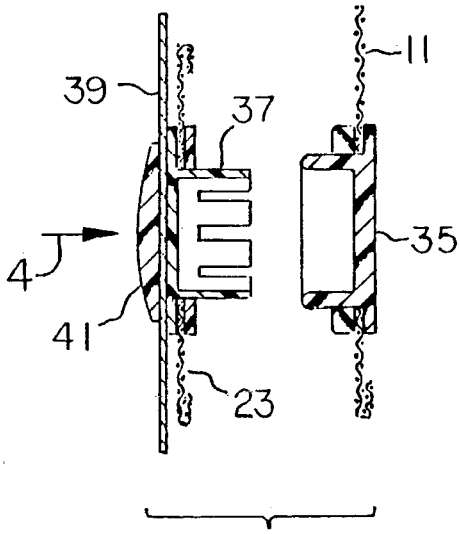
FIG. 3, is an enlarged, exploded, sectional view taken through a snap fastener combination used in the FIG. 1 swimsuit.

FIG. 3, is an enlarged, exploded, sectional view taken through a snap fastener combination used in the FIG. 1 swimsuit.

Figure 4:
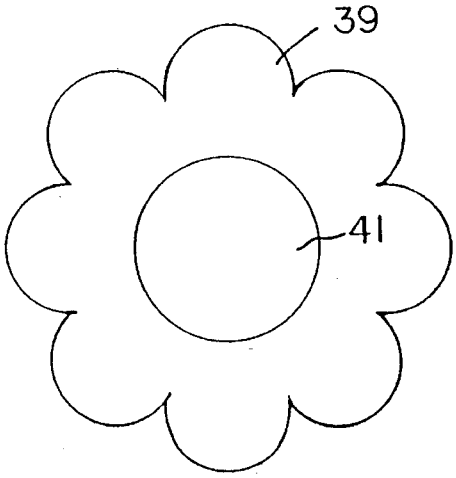
FIG. 4, is a front elevational view of the FIG. 3 assembly, taken in the direction of arrow 4.

FIG. 4, is a front elevational view of the FIG. 3 assembly, taken in the direction of arrow 4.

Referring particularly to FIGS. 1 through 4, there is shown a swimsuit 10, adapted to be worn by an infant while wearing a diaper underneath the swimsuit (bathing suit); the swimsuit is designed to substantially conceal the diaper from view, such that other children nearby are unaware that the infant is wearing a diaper. The swimsuits depicted in the various drawings herein are intended to be worn by females, not males.

As shown in FIGS. 1 through 4, the swimsuit garment comprises a main fabric section 11 having a tubular configuration for enclosing the torso of the infant. At its upper end the tubular main section 11 is provided with two arm holes 13 and a central opening 15, that form two shoulder straps 17.

The frontal wall portion of main section 11 has a lower edge 19 that is approximately at hip level when the swimsuit is worn by a female infant. The rear wall portion of main section 11, extends downwardly below the plane of edge 19, to form a wall portion 21, adapted to enclose the buttocks area of the infant.

Extending from a central point on the buttocks wall portion 21 is a fabric flap 23. The flap comprises a relatively narrow strip-like wall portion 25, adapted to extend within the crotch area of the infant, and a relatively wide triangular portion 27, adapted to extend across the abdomen area of the infant. Wide portion 27, has an upper edge 28.

As shown in FIG. 2, the flap 23 is in a flat condition extending away from the buttocks wall area 21, of main section 11. The flap 23 has a T-shape as viewed in FIG. 2. As shown in FIG. 1, flap 23, is drawn upwardly so that the corner extremities 29, of the relatively wide flap portion 27, overlap lower edge areas of main section 11. FIG. 1, represents the configuration of the swimsuit when it is worn by an infant. As previously noted, the infant will be wearing a diaper (not shown) underneath the swimsuit. The swimsuit will conceal the diaper from view.

The swimsuit will be pleated so that the tubular main section 11, conforms generally to the shape of an average infant's torso, including the buttocks area.

Also, seam 31 can be formed along the rear wall portion of main section 11 to cause the swimsuit to better conform to the infant's anatomy, especially the buttocks. Side edges 33 of the buttocks wall area 21 and flap 23, are configured so that when the swimsuit is worn edges 33 will form leg openings fitting relatively snugly around the infant's legs.

Two snap fastener members 35, are affixed to the outer surface of main section, where the swimsuit fits against the infant's hips. Fastener members 35, are spaced relatively far apart, but in close proximity to the lower front edge 19, of section 11.

Two additional snap fastener members 37, are affixed to the inner surface of flap 23 at the flap extremities 29, so that when the flap 23 is drawn up to the FIG. 1 position, the respective fastener members 37 will mate with the associated fastener members 35. The fastener members can be snapped together to retain flap 23 in the FIG. 1 position.

Snap fastener members 35 and 37, are of conventional design, as depicted generally in FIG. 3. Each snap fastener 35 can be a female fastener element, in which case each associated fastener 37, will be a male fastener element.

Flap 23 fastens to the hip areas of main section 11, so that when fasteners 37 are disengaged from fasteners 35 the flap can be pulled away from main section 11, to assume the position of FIG. 2. With the infant in a prone position facing up, the flap 23, can be positioned underneath the infant, such that the diaper on the infant is fully accessible for diaper-changing purposes. Fastener members 35 are widely spaced apart, so that the securement tabs on the diaper are fully exposed. The diaper-changing process can be accomplished quickly, and with minimal disturbance to the infant's position. After the new diaper has been secured in place, the flap 23 can be returned to its FIG. 1 position.

It is desirable that snap fastener members 37 be concealed from view, so that the purpose of flap 23 is obscured or not readily ascertained. An ornamental covering is therefore provided over the head of each fastener member 37. As shown in FIGS. 3 and 4, the ornamental covering comprises a fabric disk 39, affixed to the exposed surface of fastener member 37, and a second smaller plastic disk 41 affixed to disk 39. Disk 39 has scalloped edges to simulate the petals of a flower; disk 41, simulates the center of the flower, e.g., a sunflower.

Each disk 39 will be larger than the exposed surface of fastener member 37, whereby the simulated flower will completely conceal the fastener member 37. The shape of the ornamental covering can be varied to suit different motifs. Each covering, e.g., simulate a star, the sun, a small fish, a cluster of jewels, head of an elephant, a ribbon tied in a bow, or other design of an ornamental nature.

Fastener members 35 and 37 are preferably conventional snap fastener elements formed of a non-corrodible plastic material. However, other fastener devices, such as buttons and adhesive patches, can be used. One well known adhesive patch construction is marketed under the trademark VELCRO. Conventional interlocking snap fasteners represent the preferred fastener construction.

Figure 5:
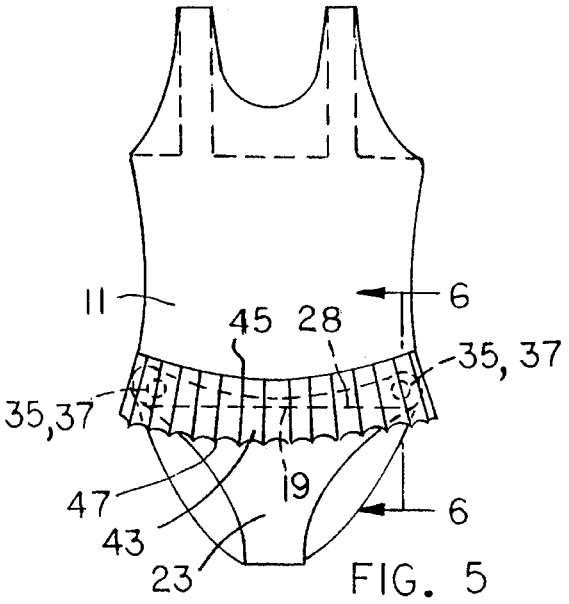
FIG. 5, is a view taken in the same direction as FIG. 1, but showing another swimsuit embodying the present invention.

FIG. 5, is a view taken in the same direction as FIG. 1, but showing another swimsuit embodying the present invention.

FIG. 5, shows a swimsuit that is basically the same as the swimsuit shown in FIGS. 1 and 2. FIG. 5, differs from FIG. 1, as regards the ornamental means for concealing fastener members 37 from view. As shown in FIG. 5, the ornamental concealment means comprises a ruffle 43, having an upper edge 45, sewn to main section 11 a slight distance above the fastener 35. The ruffle 43 hangs down so that its lower edge 47, is below the fastener assemblies 35, 37, when the swimsuit is worn. The ruffle 43 therefore conceals fasteners from view. Ruffle 43 preferably extends around the entire circumference of the swimsuit.

Figure 8:
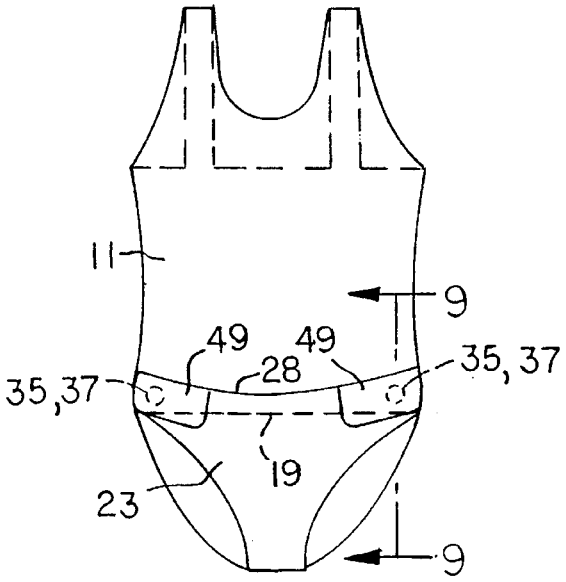
FIG. 8, is a front elevational view showing a further form that the present invention can take.
Figure 9:
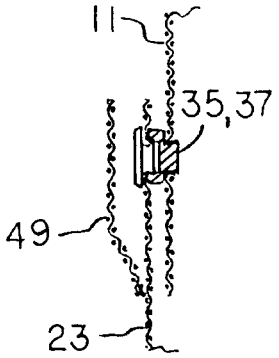
FIG. 9, is an enlarged, fragmentary, sectional view taken on line 9—9 in FIG. 8.
Figure 6:
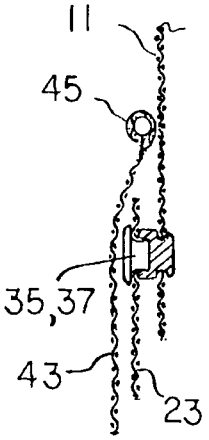
FIG. 6, is an enlarged, fragmentary, sectional view taken on line 6—6 in FIG. 5.

FIG. 8, is a front elevational view showing a further form that the present invention can take.

FIG. 8, shows a similar swimsuit, wherein the ornamental concealment means comprises two fabric panels 49 sewn onto the outer surface of flap 23, to form upwardly opening pockets. The infant can use the pockets for storage purposes. However, the primary function of the pocket-forming panels is to conceal the fastener members 37, from view.

Figure 7:
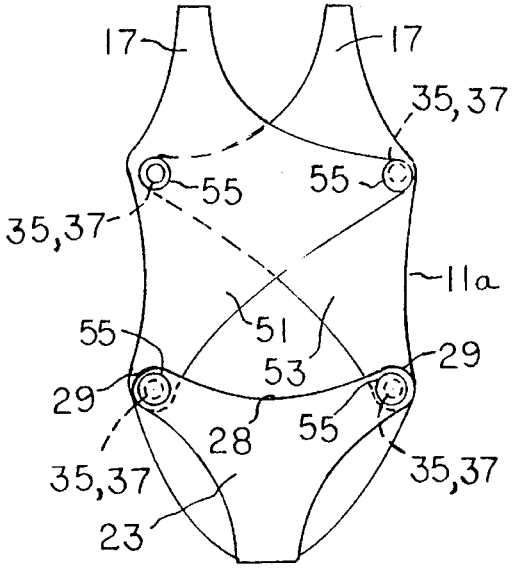
FIG. 7, is a front elevational view of another swimsuit embodying features of the present invention.

FIG. 7, is a front elevational view of another swimsuit embodying features of the present invention.

FIG. 7, illustrates a swimsuit, wherein the main section 11*a* comprises a frontal section that includes two generally triangular panels 51 and 53 arranged so that the upper portion of panel 51 extends across the front surface of panel 53. Panels 51 and 53 collectively cover the chest area of the infant.

The upper corner extremities 29 of flap 23 overlap the lower corners of triangular panels 51 and 53 to form mating surfaces for mounting snap fastener assemblies 35, 37 (that may be similar to the snap fasteners shown in FIG. 3).

In the swimsuit of FIG. 7, four snap fastener assemblies are used, i.e., two fastener assemblies at the upper corner extremities of flap 23, and two additional snap fastener assemblies at the upper corner areas of the triangular panels 51 and 53. Flap 23, can be swung to an open condition, in the same way as described in connection with the FIG. 1 construction.

Each of the four snap fastener members 37, depicted in FIG. 7, is concealed by an ornamental disk (or shield) 55. As shown, each disk 55 is a circular disk somewhat larger than the size of the associated snap fastener member 37. Disks 55, can be brightly colored to provide ornamentation to the swimsuit. The disk shape can be noncircular, if desired, e.g., in the shape of an animal's head, such as an elephant, lion, zebra, parrot, or monkey. Triangular panels 51 and 53, can be of different colors to add further ornamental interest.

Figure 10:
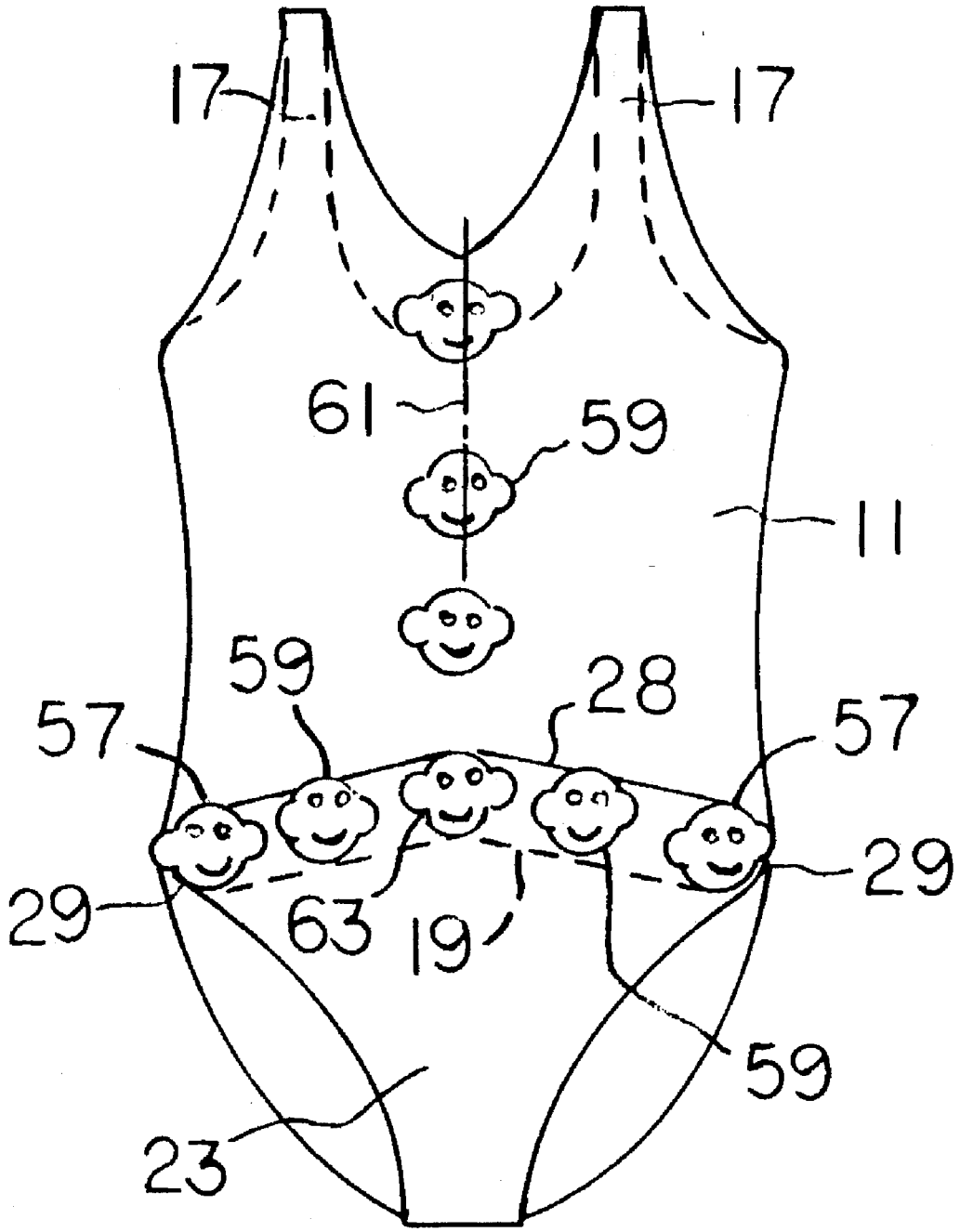
FIG. 10, is a front elevational view of another embodiment of the present invention.

FIG. 10, is a front elevational view of another embodiment of the present invention.

FIG. 10, shows a swimsuit, wherein flap 23 has an upper edge 28 located above the lower edge 19 of the frontal area of main section 11, whereby the upper edge area of flap 23 overlaps the lower front edge area of main section 11. Snap fastener assemblies are located at the corner extremities 29, of flap 23, and mated hip areas on main section 11, so that flap 23 can be releasably secured to main section 11 in the previously described fashion.

In order to conceal the snap fastener assemblies, two ornamental disks, or panels, 57, are affixed to the outer surface of flap 25, so as to overlie the associated fastener members carried by the flap 23. To obscure the demarcation between main section 11 and flap 23, several additional ornamental panels 59, are affixed to flap 23, and the frontal area of main section 11. As shown in FIG. 10, each ornamental panel has the shape of a clown face; other ornamental shapes can be used.

As an optional feature, a third fastener assembly can be provided between flap 23, and main section 11, along the central vertical axis 61. An ornamental panel 63, can be affixed to the outer surface of flap 23, to conceal this last-mentioned fastener assembly panel. The various ornamental panels (shields) 57, 59 and 63, collectively draw attention away from the upper edge 28, of the flap 23, such that the flap upper edge 28 is relatively inconspicuous.

A common feature in the various swimsuits shown in the drawings, is the flap 23, having fastener elements at its upper corner extremities 29, whereby the flap 23 can be drawn away from main section 11, for full access to the infant's diaper.

The present invention, described above, relates to a swimsuit for infants. Features of the present invention are recited in the appended claims. The drawings contained herein necessarily depict structural features and embodiments of the swimsuit for infants, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A swimsuit for a female infant wearing a diaper, comprising:

a form-fitting swimsuit garment that includes a main fabric section for enclosing the torso of a female infant, said main fabric section including a front panel having a lower front edge that comprises fabric areas seatable against the hips of the infant wearer, and a rear panel seatable against the buttocks of the infant wearer;

a T-shaped fabric flap extending forwardly from the buttocks area of said main section, said flap comprising a relatively narrow portion for enclosing the crotch area of the infant over the diaper, and a relatively wide flaring portion for enclosing the abdomen area of the infant over the diaper;

said wide portion of the T-shaped flap having corner extremities that overlap said hip-seating areas of the main fabric section when the swimsuit is worn by a female infant;

said main fabric section having an inner surface and an outer surface;

said fabric flap having an inner surface and an outer surface;

first and second fastener members located on the outer surface of said main fabric section proximate to said lower front edge of said front panel;

said first and second fasteners being spaced apart on the hip-seating areas of the main fabric section;

third and fourth fastener members located on the inner surface of said flap at the corner extremities of said relatively wide portion;

said third and fourth fastener members being engageable with said first and second fastener members, whereby the flap overlies a diaper worn by the infant;

said third and fourth fastener members being detachable from said first and second fastener members, whereby the relatively wide portion of the flap can be drawn away from the main fabric section to partially expose the diaper for permitting the diaper to be easily changed;

an ornamental means permanently attached to said swimsuit garment for concealing said third and fourth fastener members when the respective fastener members are engaged; and said ornamental means comprising a ruffle having an attachment area attached to said main section of the garment so as to normally hang down from the ruffle attachment area; said ruffle extending around the entire circumference of the swimsuit.

* * * * *